United States Patent [19]

Horita et al.

[11] Patent Number: 5,035,029

[45] Date of Patent: Jul. 30, 1991

[54] SLIDE FASTENER AND FASTENER ELEMENTS THEREFOR

[75] Inventors: Yoshiyuki Horita; Kiyoshi Nakayama; Yasuhiko Sugimoto; Norio Kikukawa; Yoshiharu Yamaguchi; Shigeru Funakawa, all of Toyama, Japan

[73] Assignee: Yoshida Kogyo K.K., Tokyo, Japan

[21] Appl. No.: 493,434

[22] Filed: Mar. 14, 1990

[30] Foreign Application Priority Data

Mar. 16, 1989 [JP] Japan ..... 1-62246
Jun. 9, 1989 [JP] Japan ..... 1-147333

[51] Int. Cl.[5] ..... A44B 19/40

[52] U.S. Cl. ..... 24/394; 24/396; 24/405

[58] Field of Search ..... 24/394, 395, 396, 391, 24/398, 397, 432, 405, 415; 428/458; 354/288 M; 5/434

[56] References Cited

U.S. PATENT DOCUMENTS

| | | | |
|---|---|---|---|
| 2,495,033 | 1/1950 | Sullivan | 24/405 |
| 3,768,125 | 10/1973 | Frohlich | 24/396 |
| 3,991,230 | 11/1976 | Dickie et al. | 428/458 |
| 4,247,600 | 1/1981 | Adachi | 354/288 M |
| 4,523,588 | 6/1985 | Dolsky | 5/434 |
| 4,604,774 | 8/1986 | Yamaguchi et al. | 24/396 |

*Primary Examiner*—Victor N. Sakran
*Attorney, Agent, or Firm*—Hill, Van Santen, Steadman & Simpson

[57] ABSTRACT

The present invention provides fastener elements for use in a slide fastener in which, regardless of the quality of material, a metallic coating layer having an excellent adhesiveness and 0.001 to 1.0 μm in thickness is simply and easily formed on the surface of a fastener element member so that the surface thereof gives out the luster of metal. The surface of the metallic coating layer may further be formed at least thereon with a finishing coat layer. In the present invention, there is further provided a slide fastener having a light weight and flexibility in which such a fastener element member as being made synthetic resin having the luster of metal on the surface thereof.

16 Claims, 6 Drawing Sheets

SLIDE FASTENER AND FASTENER ELEMENTS THEREFOR

BACKGROUND OF THE INVENTION

1. Field of the Invention

This invention relates to a slide fastener, and more particularly to fastener elements for use in a slide fastener with a metallic coating formed on the surface thereof and having a metallic luster.

2. Description of the Prior Art

In the conventional fastener elements for use in slide fasteners, to provide fastener elements having a metallic coating formed on the surface thereof and having a metallic luster or a color tone applicable to highly fashionable sports wears and high-class bags, in case of fasteners elements made of a synthetic resin, fastener elements having a metallic luster are formed by mixing a coloring agent into the synthetic resin, whilst in case of fastener elements made of a metallic material, they have been given a metallic luster by a color tone of the metallic material forming the fastener elements themselves.

However, in the case of fastener elements made of a synthetic resin, since a coloring agent is mixed with a synthetic resin, a metallic luster could not be obtained at the surface of the fastener elements, whilst in the case of metallic fastener elements, since in producing them from a metallic material they are subjected to cutting work, etc., minute irregularities are formed on the surface thereof thereby impairing the metallic luster.

As is well-known, slide fasteners are broadly classified into plastic fasteners using fastener elements made of synthetic resins, and metallic fasteners using metallic fastener elements. The metallic fasteners are disadvantageous in that use of lots of a non-ferrous metal is required, thus rendering the manufacturing cost thereof more expensive than that of the plastic fasteners.

While, the slide fasteners made of a synthetic material are advantageous in that they can be produced at comparatively low costs, and fastener types and fastener elements thereof can be put in any desired color tone which is identical or different from each other, they have come to occupy a substantial proportion of slide fasteners presently in use. However, in spite of the fact that they can be put in any desired color tone, no slide fasteners made of a synthetic resin having a metallic luster are available yet.

Whilst in the field of application to sky wears and high-class bags, in particular in the field of sky wears, light-weight and fashionability are required to pursuit amenity, therefore it has so far been demanded to provide slide fasteners made of a synthetic resin having a metallic luster. To cope with such demands, it has been known to give slide fasteners a color tone which is similar to a metallic luster, either by mixing the synthetic resin with a pigment or by dyeing. However, it is to be regretted that the color tone or luster obtained by such methods has been far from the desired one.

SUMMARY OF THE INVENTION

The present invention has been made in view of the above-mentioned circumstances in the prior art, and has for its object to provide a slide fastener using fastener elements made of a synthetic resin, which are of light weight and which have a metallic luster.

Another object of the present invention is to provide fastener elements for use in a slide fastener with a metallic coating layer formed thereon which can be deposited simply and readily on the surface of a fastener element member, regardless of the material of the latter, and which has a metallic luster.

To achieve the above-mentioned objects, according to a first aspect of the present invention, there is provided a slide fastener including fastener elements wherein a fastener element member made of a synthetic resin has a metallic coating layer with a thickness of 0.001 to 1.0 μm formed on the surface thereof so as to give the surface of the fastener elements a metallic luster.

To achieve the above-mentioned objects, according to a second aspect of the present invention, there is provided a slide fastener as set forth in the first aspect, characterized in that the fastener element member made of a synthetic resin is a continuous coiled or zigzag fastener element member, and the continuous fastener element member is sewn by a sewing yarn onto one side of a fastener tape.

According to a third aspect of the present invention, there is provided a slide fastener as set forth in the second aspect, characterized in that the sewing yarn is a transparent yarn.

According to an fourth aspect of the present invention, there is provided a slide fastener as set forth in the second aspect, characterized in that the continuous fastener element member has a cord inserted therethrough, and the cord has also a metallic coating layer with a thickness of 0.01 μm or over formed or deposited thereon.

According to a fifth aspect of the present invention, there is provided a slide fastener as set forth in the second aspect, characterized in that the continuous fastener element member has a cord inserted therethrough, the core has also a metallic coating layer with a thickness of 0.01 μm or over formed or deposited thereon, and the sewing yarn is a transparent yarn.

Further, to achieve the above-mentioned objects, according to a sixth aspect of the present invention, there are provided fastener elements for use in a slide fastener, characterized in that a fastener element member has a metallic coating layer formed or deposited on the surface thereof to give out a metallic luster, and that the metallic coating layer has a finishing coat layer formed or deposited further thereon.

To achieve the above-mentioned objects, according to a seventh aspect of the present invention, there are provided fastener elements for use in a slide fastener, characterized in that the surface of a fastener element member is first of all formed with an under coat layer, and then the surface of the under coat layer is formed with a metallic coating layer, and further the surface of the metallic coating layer is formed with a finishing coat layer.

To achieve the above-mentioned objects, according to a eighth aspect of the present invention, there are provided fastener elements for use in a slide fastener as set forth in any one of the first and third aspects, characterized in that the thickness of the metallic coating layer is in the range of 0.05 ~ 1.0 μm.

Since the present invention is constructed such that a fastener element member has a metallic coating layer formed on the surface thereof and the metallic coating layer has a finishing coat layer formed thereon, as mentioned hereinabove, the fastener elements can be applied simply and easily with a metallic coating layer having a metallic luster, regardless of the material of the fastener element member. Further, since the metallic coating layer has a finishing coat layer formed or deposited thereon, there is no tendency of the metallic coating layer peeling off by repeated sliding contacts of a slider when opening and closing the slide fastener, and also by washing, etc. so that the fastener elements and the cord can provide a metallic luster for long time.

Still further, since the surface of the fastener element member is applied with an under coat layer to smooth minute irregularities on the surface thereof so that the metallic coating layer applied on the surface of the under coat layer can provide a metallic luster.

Furthermore, according to the present invention, since the fastener element member made of a synthetic resin has a metallic coating layer with a thickness of 0.001 to 1.0 μm formed or deposited on the surface thereof, a flexible and light-weight slide fastener having a metallic luster can be provided. Therefore, the slide fastener of the present invention can meet the requirements in terms of fashionability satisfactorily, and also can enhance the commercial value of products such as sky wears, high-class bags and others to which the slide fastener of the present invention is applied.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

The present invention will now be described in detail below by way of several emebodiments thereof with reference to the accompanying drawings.

In the first place, several embodiments of a slide fastener using fastener elements made of a synthetic resin will now be described with reference to FIGS. 1 to 6.

Figure 1:
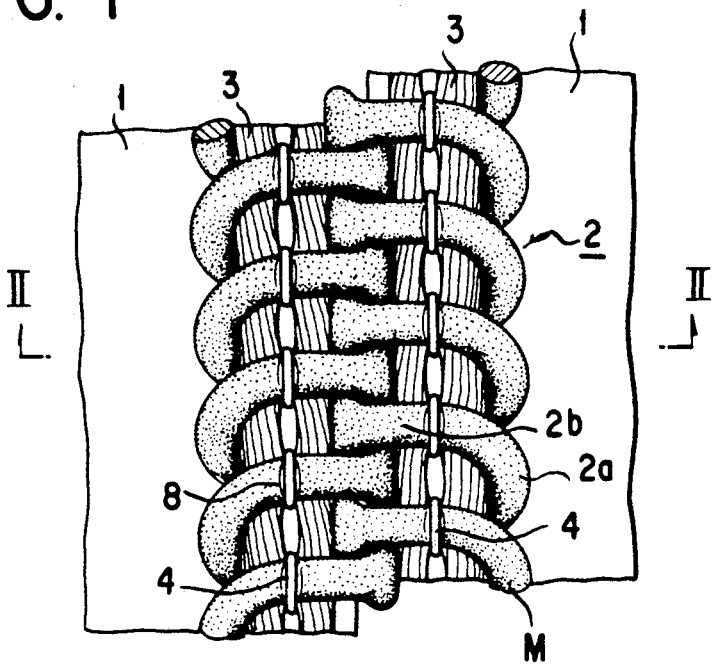
FIG. 1 is a plan view showing one embodiment of a slide fastener of the present invention using fastener elements made of a synthetic resin.
Figure 2:
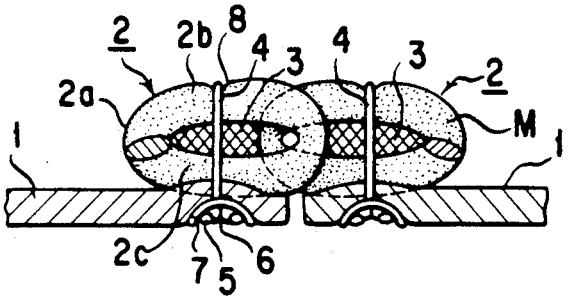
FIG. 2 is a sectional view taken along line II—II in FIG. 1.
Figure 3:
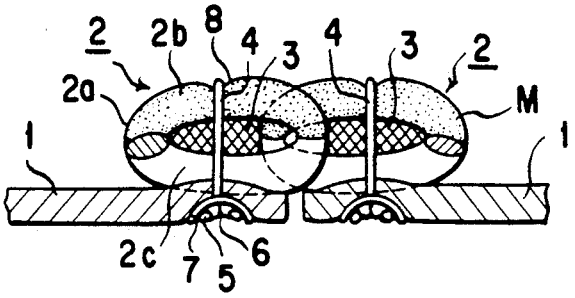
FIG. 3 is a sectional view similar to FIG. 2, but showing another embodiment of the slide fastener of the present invention.

FIGS. 1 to 3 show embodiments wherein the present invention is applied to a continuous fastener element member, but it will be apparent that the present invention can also be applied to other fastener element members molded by injection molding entirely in the same manner. In the drawings, reference numeral 1 denotes a fastener tape, 2 a coiled fastener element made of a synthetic resin, and 3 a cord which is inserted between upper and lower legs **2*b* and 2*c* and inside of a connecting and reversal portion 2*a*. Reference numeral 4 denotes a sewing or stitching yarn for sewing the fastener element 2 to one side of the fastener tape 1** by single-thread chain stitch.

The sewing yarn 4 is passed from the upper leg **2*b* of the fastener element 2 through the cord 3, and on the other side of the fastener tape 1 the loop 5 of the seam of sewing yarn extends continuously through a crossing portion 6 thus forming a chain of the yarn. As this sewing yarn 2, a heat-shrinkable yarn such as, for example, a monofilament yarn formed of nylon or polyester, etc. is used, and in particular the above-mentioned transparent monofilament yarn should preferably be used. When the fastener elements are sewn by the sewing yarn to the fastener tape and subjected to thermosetting, the whole sewing yarn undergoes a heat shrinkage thus causing a strong binding force exerted between the fastener element 2 and the fastener tape 1. As a result, in the above-mentioned crossing portion 6, the fastener tape 1 is pulled towards the lower leg 2*c* of the adjoining fastener element 2 thus forming a recess 7 into which the crossing portion 6 bites. Further, the strong binding force exerted by the sewing yarn 4 forms a groove 8 on the surface of the upper leg 2*b*, into which the sewing yarn 4 bites. The drawings show the case where the fastener element 2** is sewn by single-thread chain stitch onto the fastener tape; however, two-thread chain stitch using a needle thread and a bobbin thread may be effected instead.

The above-mentioned fastener element 2 and the cord 3 are each applied with a metallic coating of Ni, Cu or Ag, etc. according to the present invention. The thickness of a metallic coating layer M deposited on a fastener element member 2' (Refer to FIGS. 4 to 6) should suitably be 0.001 ~ 1 μm. In case the thickness of the metallic coating is less than 0.001 μm, then it becomes difficult to obtain a desired color and luster, whilst in case the thickness of the coating is more than 1.0 μm, then the flexibility of the fastener element member per se which is required in the sliding movement thereof is lost, and there is a fear of the plating on the fastener elements causing cracks. Therefore, it is not desirable that the thickness of the coating exceeds 1.0 μm. The thickness of the metallic coating should preferably be 0.001 ~ 0.1 μm taking into consideration productivity and economy, such as the treating speed and the consumption of raw materials. Whilst, the thickness of the metallic coating layer deposited on the surface of the cord may be the same as that of the metallic coating layer deposited on the above-mentioned fastener element, or may be about ten times as that of the latter. But, in case of the cord, when, for example, the cord is subjected to a chemical plating treatment, a catalyst then used is liable to deposit on the cord, and the metallic coating layer deposits easily on the cord. Therefore, the thickness of the metallic coating layer on the cord is normally kept more than 0.01 μm.

To form the metallic coating layer, a variety of methods, such as, for example, wet process (chemical plating), dry process (vacuum deposition, ion plating, sputtering), and transfer process can suitably be used. Upon the formation of the metallic coating layer, the surface of the fastener elements whose fastener element members are sewn onto the fastener tape, and the surface of the cord may be applied with a metallic coating layer at the same time (In this case, the coating treatment is made with the fastener tape covered with masking). Alternatively either the fastener elements alone or the fastener elements in interdigitated conditions may be subjected to the metallic coating treatment, and then sewn to the fastener tape. (In this case, there is no possibility of contamination of the fastener tape, and the fastener elements can be matched with various colors of the fastener tape.

An example of a product manufacturing process using a chemical plating process comprises the steps of winding fastener elements on bobbins, subjecting the fastener elements to the chemical plating, drying the elements, unwinding the elements, sewing the slide fastener chain, and setting the slide fastener chain. Further, the plating process consists, for example, of the following work steps to be effected in turn.

(1) Pre-etching

The fastener elements are treated, for example, with an organic solvent at normal temperatures for about ten minutes. The purpose of this treatment is to remove contaminants or low-molecular weight compounds utilizing the effect of the solvent swelling the surfaces of the fastener elements.

(2) Second Etching

The fastener elements are treated, for example, with aqueous chromic acid at about 70° C. for about ten minutes.

This treatment is made to cause roughening of the surfaces of the fastener elements by the etching effect to improve the adherence of the metallic coating due to the resultant anchoring effect. Removal and flushing of fats and oils are made at the same time.

(3) Neutralization

Neutralization is made to remove chromic acid deposited on the roughened surface of the synthetic resin and to prevent carrying of the chromic acid into the liquid for the subsequent work step. This neutralization treatment is made at about 70° C., for example, for five minutes.

(4) Third Etching

Fastener elements and cords made of engineering plastics are subjected to etching treatment using potassium permanganate solution at about 70° C. for about five minutes for the same purpose as that of the above-mentioned item (2) "Etching".

(5) Intermediate Flushing - Etching

This flushing is made for the same purpose as that of the above item (2) "Etching".

(6) Water Washing

The fastener elements and cords are washed with sufficient amount of water to prevent carrying of metals such as chrome and potassium into the subsequent work step.

(7) Predipping

The fastener elements and cords are dipped, in, for example, an aqueous solution of hydrochloric acid for a short time, with the aim of maintaining predetermined values of density and PH.

(8) Addition of Catalyst

This is made to provide $Sn^{2+}$ (tin) and $Pd^{2+}$ (palladium) to the surface of the plastic resin. The fastener elements and cords are dipped in a liquid containing these ions for a short time.

(9) Promotion of Reaction

The tin ion $Sn^{2+}$ in the liquid reduces the palladium ion $Pd^{2+}$ to cause deposition of metallic palladium on the surface of the plastic resin.

$$Sn^{2+} + Pd^{2+} \rightarrow Sn^{4+} + Pd$$

The reaction occurs under acid conditions. Further, the second tin ion ($Sn^{4+}$) is removed by water washing.

(10) Chemical Plating

Through the action of reducing agents contained in the plating solution (such as, phosphate, boron hydride, aminovolan, and hydrazine, etc.), a metal such as, for example, nickel, etc. deposits on the surface of the plastic resin in the presence of metallic palladium as a catalyst.

As a result of investigation of drying conditions to improve the adherence of the plating, it has been proven that it is proper to dry the metallic coating after the plating thereof at 80° to 180° C. for 30 to 240 minutes, and the drying should more preferably be made at 95° to 120° C. for 40 to 180 minutes. By the above-mentioned drying, the adherence of the plating will become about ten times higher than that obtained by natural drying. Further, in case the material of the coiled fastener elements is different from that of the cords (In case, for example, the fastener elements are made of Nylon-6, whilst the cords are made of polyester), it is difficult to plate the fastener elements and cords at the same time to improve the adherence of the plating, because treating solutions suitable for their materials are different. Therefore, in case the fastener elements and cords are subjected concurrently to chemical plating, it is required that both the fastener elements and cords are formed of the same material, for example, polyester.

Figure 4:
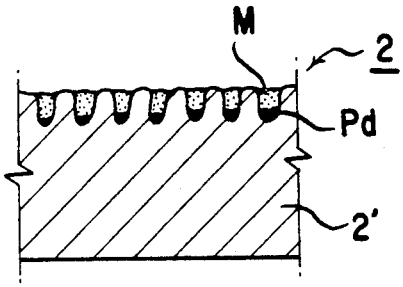
FIG. 4 is a fragmentary, enlarged sectional view of a fastener element having a metallic coating layer formed on the surface thereof by a chemical plating process.

Microscopic deposited conditions of the metallic coating layer vary with the above-mentioned treating methods. For example, the metallic coating layer formed by chemical plating is as shown in FIG. 4, according to observation by means of a microscope. Palladium is deposited in minute holes scattered on the surface of the synthetic resin fastener element member 2' which result from the surface being roughened, and a metallic layer M is deposited on the palladium deposits. If the thickness of the coating is more than 0.3 μm, then the coating becomes continuous. Even in the condition metal deposits are scattering as shown, the metallic coating is given a sufficient metallic luster. The most optimum thickness of the metallic coating layer formed on the fastener element member 2' by chemical plating is 0.05 to 0.3 μm.

Figure 5:
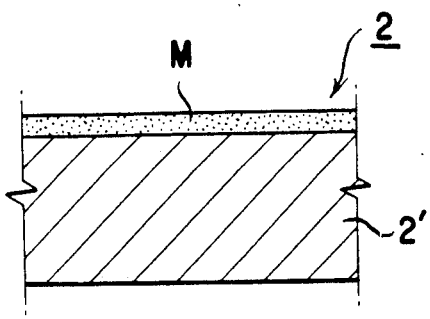
FIG. 5 is a fragmentary, enlarged view of a fastener element having a metallic coating layer formed on the surface thereof by ion plating process.
Figure 6:
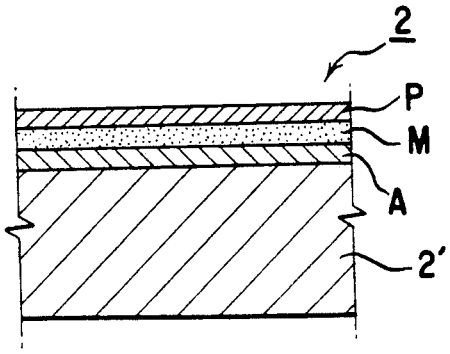
FIG. 6 is a fragmentary, enlarged view of a fastener element having a metallic coating layer formed on the surface thereof by a transferring process.

The condition of the metallic coating layer formed by ion plating is as shown in FIG. 5, with a metallic coating layer M having been deposited uniformly on the surface of the fastener element member 2' made of a synthetic resin. The optimum thickness of the coating layer formed by ion plating is in the range of 0.01 ~ 0.1 μm. It is enough to conduct the ion plating treatment for about 60 seconds from the time of coloring which occurs three seconds after the commencement of the treatment. An example of the coating layer formed by a transfer process is as shown in FIG. 6, wherein an adhesive layer A, a metallic coating layer M and a protective layer P are laminated in turn on the surface of a fastener element member 2' made of a synthetic resin.

Further, in case of the chemical plating, the metallic coating layer M is formed on the whole front and rear surfaces of the fastener element by a single treatment as shown in FIG. 2. In the case of the ion plating process and the transfer process, the metallic coating layer is formed only on the front surfaces of the fastener element and the cord. (Refer to FIG. 3). Thus, since the metallic coating layer is not deposited on invisible portions of the fastener element and the cord, an economical advantage is obtained. Both the above two cases come under the present invention, and even in the case that the metallic coating layer is formed only on the front side of the fastener element, a satisfactory metallic luster is obtained. Further, as occasion demands, the metallic coating layer formed on the fastener element may be applied with a transparent coating material.

It is to be understood that the foregoing description is merely illustrative of preferred embodiments of the present invention, and the scope of the appended claims.

Figure 7:
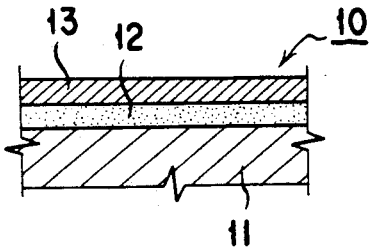
FIG. 7 is an enlarged sectional view of a portion of a fastener element according to a third embodiment of the present invention.

In the next place, referring to a further embodiment shown in FIG. 7, reference numeral 11 denotes a fastener element member made either of any one of synthetic resins such as, for example, polyester, polyamide, polyethylene, polypropylene, polyacetal, and polycarbonate, etc., or of any one of metallic materials such as an aluminium alloy and a copper alloy (nickel silver, brass), etc. Reference numeral 12 denotes a thin metallic coating layer made of any one of metallic materials such as aluminium, chrome, nickel, stainless steel, silver, gold, copper and brass, etc., or alloys thereof deposited on the surface of the fastener element member 11 by either one of vapor deposition process, high-frequency ion plating process, sputtering process, and vapor phase plating process (cathode vapor deposition (CVD) process), etc.. The thickness of the metallic coating layer 12 thus formed on the fastener element 10 should optimally be about 0.05 ~ 1.0 μm. If the thickness of the metallic coating layer 12 is less than this value, then the strength thereof becomes weak and the metallic luster thereof also becomes weak. To the contrary, if the thickness of the metallic coating layer 12 is more than this value, then the adherence of the coating layer becomes poor, and in particular in case the fastener element member 11 is made of a synthetic resin, it becomes rigid thus impairing its function as a fastener, and so the coating layer becomes liable to be cracked or peeled off when it is bent. Reference numeral 13 denotes a finishing coat layer for protecting and coloring the metallic coating layer 12, which is formed by spraying the surface of the layer 12 with a coating material selected from among thermosetting, electron radiation curing, and ultraviolet curing synthetic resins such as acrylic resin, urethane, polyester, urea-melamine, epoxy resin, amino-alkyd plastics, polyisocyanate, and alkyl-titanate, etc., or nitrocellulose, etc., and then drying the sprayed coating, which serves to give an excellent metallic luster and enhance the adherence and resistance thereof to washing. Further, the finishing coat layer 13 is required to be transparent or translucent to enable the color tone of the metallic coating layer 12 located underneath to be seen through, or alternatively it may be put in any desired color which does not interfere with the seeing through it. For example, by applying a finishing coat layer which has a yellow color on an aluminium metallic coating layer with a silvery luster, a fastener element 10 having a golden metallic luster can be produced. Further, by applying a finishing coat layer having a green color on an aluminium metallic coating layer, a fastener element 10 having a green metallic luster can be obtained. Thus, by applying a finishing coat layer having any one of a wide variety of colors which do not hinder seeing through it, on a metallic coating layer having a silvery luster, a metallic coating layer having a metallic luster matching with the color of the finishing coat layer can be obtained.

Figure 8:
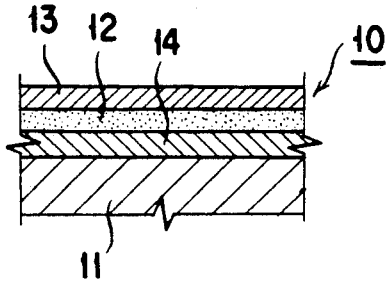
FIG. 8 is an enlarged sectional view of a portion of a fastener element according to a fourth embodiment of the present invention.

Still another embodiment shown in FIG. 8 is the one which has an under coat layer 14 applied onto the surface of the fastener element member 11 prior to forming the metallic coating layer 12 of the first embodiment shown in FIG. 7 to improve the surface condition thereof. This under coat layer 14 is adapted for use in cases where the fastener element member 11 has minute surface irregularities and is thus poor in the luster and in the adherence of a metallic material by vapor deposition. This under coat layer 14 is formed by spraying the surface of the fastener element member 11 with a coating material which is either a synthetic material similar to the finishing coat applied to the surface of the metallic coating layer, or nitrocellulose. Further, the under coat layer 4 may be opaque since it serves only to improve the surface condition of the fastener element member 11. Stated in brief, the second embodiment shows a fastener element 10 having a metallic luster which is produced by forming the metallic coating layer 12 on the surface of the under coat layer 14, and then forming the finishing coat layer 13 thereon as in the case of the first embodiment shown in FIG. 7. This embodiment is adapted for use in the cases where metallic fastener element members which are liable to have surface irregularities when they are cut or tightened in the manufacturing process thereof are subjected to metallic coating treatment and also in the cases where fastener element members of a synthetic resin are formed directly by an extrusion molding machine or by an injection molding machine with a tendency to form irregularities on their surfaces, which require the application of the under coat layer 14. Further, in case a coiled or zigzag fastener element member is formed by extruding a synthetic resin into a continuous strip by an extrusion molding machine, stretching it and then bending it, the surface thereof becomes smooth, and even if it possesses irregularities, the degree thereof is as small as 0.05 1.0 μm or under, and therefore there is no need of applying any under coat layer.

In the next place, a method of forming a metallic coating having a metallic luster on the surface of a fastener element member according to the present invention will be described below. In case a coiled of zigzag fastener element member is formed by bending a continuous rectilinear strip of a synthetic resin according to the embodiment shown in FIG. 7, the fastener element member is subjected firstly to an ultrasonic wave flushing treatment using a solvent (such as, for example, Freon and trichloethylene, etc.), and then to a preliminary drying. Subsequently, the fastener element member is formed with a thin metallic coating layer having surface irregularities of about 0.05 to 1.0 μm by subjecting the surface thereof to vapor deposition of aluminium, for example according to the high-frequency ion plating process. After that, the surface of the fastener element member is subjected to a metallic coating treatment to give it a metallic luster by spraying the surface of the metallic coating layer with a finishing coat layer such as, for example, a mixture of polyester polyol having any color and an isocyanate compound at a weight ratio of 100 to 50 parts, drying the finishing coat layer by hot air, and then allowing it to cure by aging.

In the next place, a metallic coating formation treatment to be provided to both fastener element members made of a synthetic resin and of a metallic material, according to the second embodiment shown in FIG. 8 will now be described below. Further, it is to be noted that the fastener element member of a synthetic resin is formed directly by molding a synthetic resin by means of an extrusion molding machine or by means of an injection molding machine, and has surface irregularities of 0.05~1.0 μm or over. The fastener element members made of a synthetic resin and of a metallic material are firstly subjected to ultrasonic flushing treatment using a solvent (Freon and trichloethylene, etc.), and then to a preliminary drying. Subsequently, the surfaces of the fastener element members are sprayed with an under coat layer such as, for example, a mixture of acrylic polyol and an isocyanate compound (curing agent) at a weight ratio of 100 to 25 parts, and then dried by hot air. After that, as in the case of the embodiment shown in FIG. 7, the under coat layer thus formed on each of the fastener element members is applied with a metallic coating layer by a high-frequency ion plating process, and then a finishing coat layer is applied.

Further, the above-mentioned metallic coating treatment is conducted mainly after the molding of the fastener element member before attaching it to a fastener tape; however in case of a coiled or zigzag fastener element member formed by bending a continuous rectilinear strip of a synthetic resin, this treatment may be made to the continuous rectilinear strip before it is formed into a fastener element member. Further, after attaching the fastener element member to a fastener tape and covering the portions other than the fastener element member, such as the fastener tape etc., with masking tape or the like, the exposed surface of the fastener element member may be subjected to the metallic coating treatment.

Figure 9A:
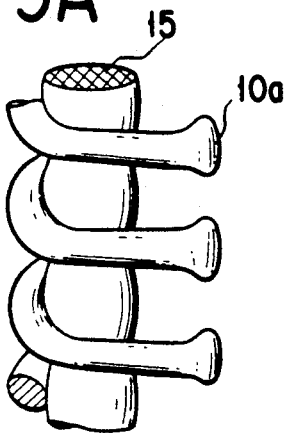
FIGS. 9A, 9B and 9C are a plan view of a fastener element member which is coiled around a cord, and sectional views showing two embodiments wherein fastener element members are attached to their respective fastener tapes.
Figure 10A:
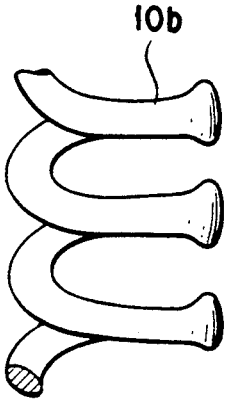
FIGS. 10A and 10B are a plan view of a coiled fastener element member without any cord, and a sectional view showing the condition of the fastener element member attached to a fastener tape.
Figure 9B:
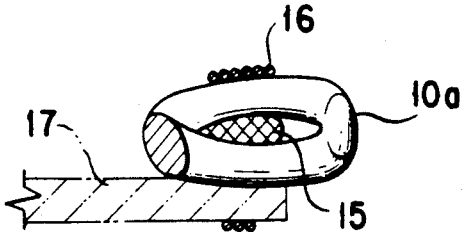
Figure 10B:
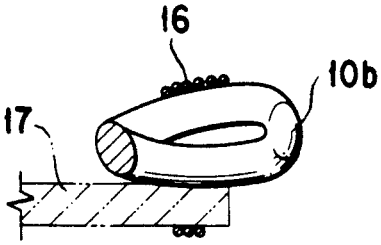
Figure 9C:
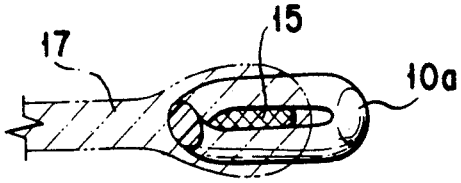
Figure 11A:
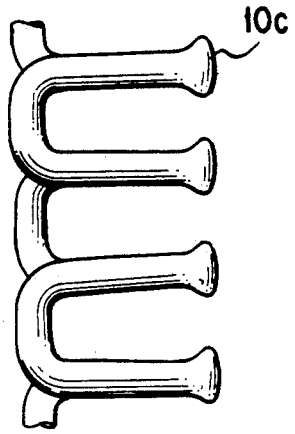
FIGS. 11A and 11B are a plan view of a zigzag fastener element member, and a sectional view showing the condition of the fastener element member attached to a fastener tape.
Figure 12A:
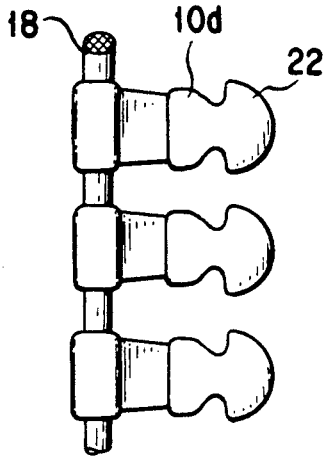
FIGS. 12A and 12B are a plan view of a fastener element member formed by extrusion molding, and a sectional view showing the condition of the fastener element member attached to a fastener tape.
Figure 11B:
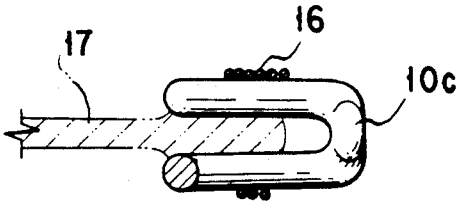
Figure 12B:
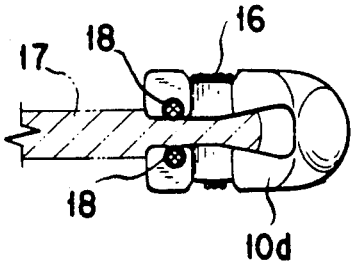
Figure 13A:
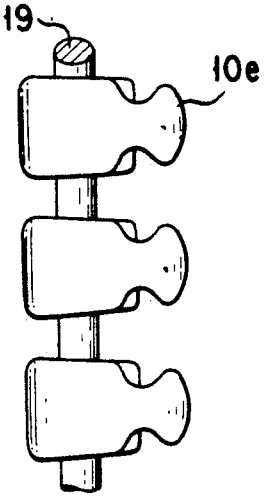
FIGS. 13A and 13B are plan view of a fastener element member formed by injection molding, and a sectional view showing the condition of the fastener element member attached to a fastener tape.
Figure 13B:
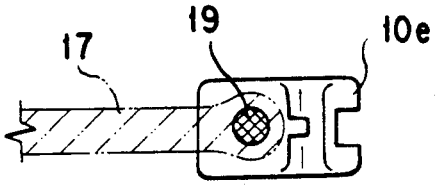
Figure 14A:
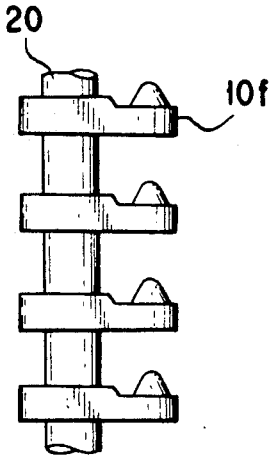
FIGS. 14A and 14B are a plan view of a metallic fastener element member, and a sectional view showing the condition of the fastener element member attached to a fastener tape.
Figure 15A:
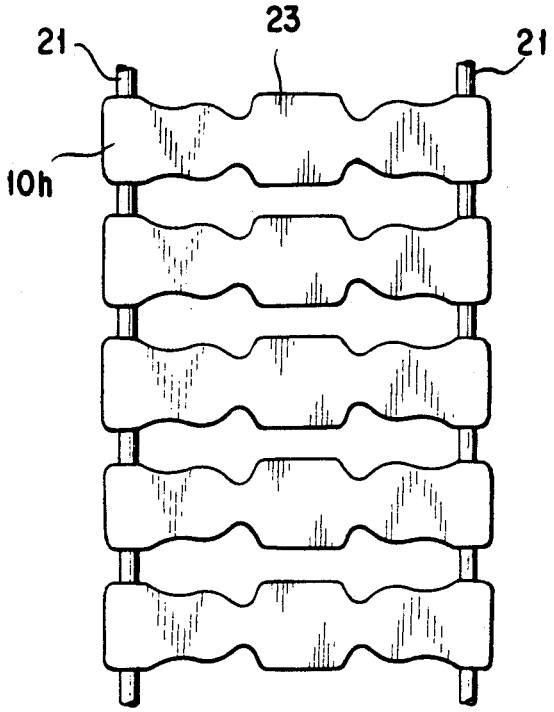
FIGS. 15A, 15B and 15C are a plan view of fastener element members formed by extrusion molding, a front view of the fastener element having a metallic luster applied to the inside of the plastener element member, and a sectional view showing the condition of the fastener element attached to a fastener tape.
Figure 14B:
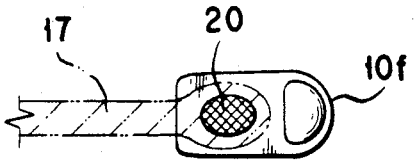
Figure 15B:
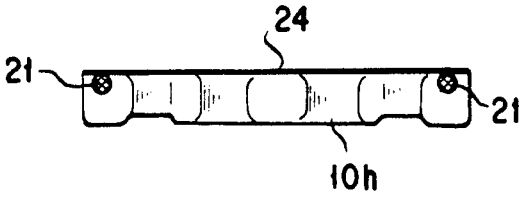
Figure 15C:
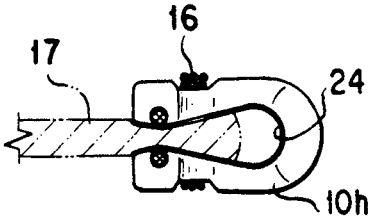
Figure 16A:
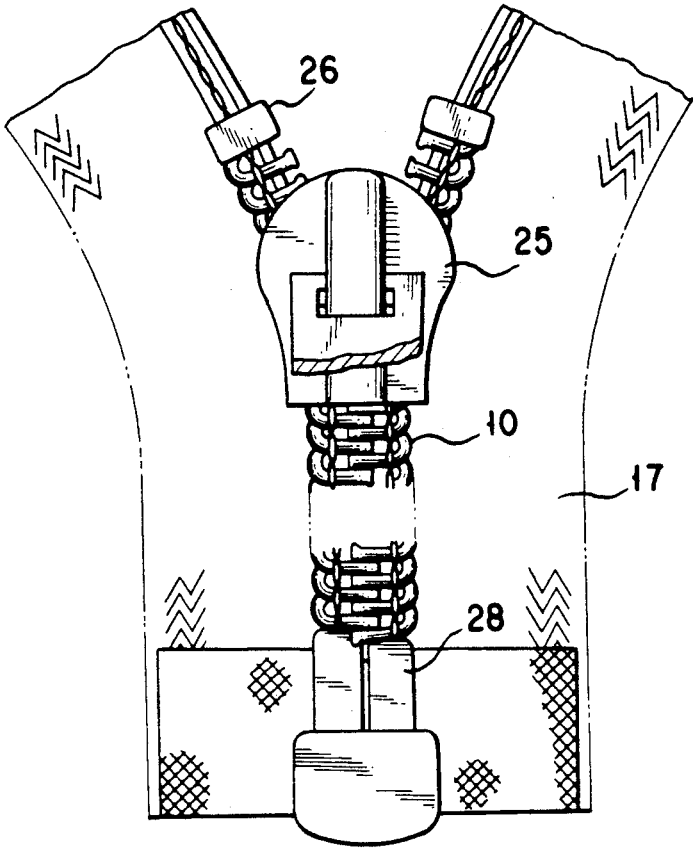
FIGS. 16A and 16B are a fragmentary plan view of a slide fastener to which fastener elements of the present invention are attached, and a plan view of the lower end of the slide fastener.
Figure 16B:
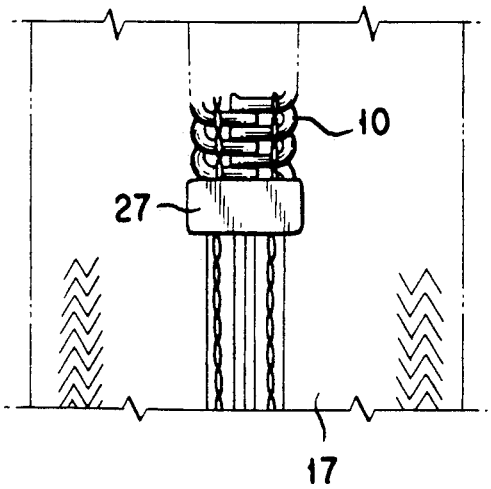

FIGS. 9A to 16B show various embodiments of the fastener element member to which the present invention is applied. FIGS. 9A to 10B show coiled fastener element members each of which is formed by bending a continuous rectilinear strip as a starting material. As shown in FIG. 9A, a fastener element member 10*a* through which a cord 15 is passed is subjected to the metallic coating treatment to give it a metallic luster. After that, as shown in FIG. 9B, the fastener element member 10*a* is sewn onto a fastener tape 17 by a sewing yarn 16, or alternatively, as shown in FIG. 9C, simultaneously with the weaving of the fastener tape 17. The fastener element member 10*a* is woven into the fastener tape 17. Further, FIG. 10A shows an embodiment wherein the fastener element member 10*b* is not provided with the cord 15 and is subjected to the metallic coating treatment. After that, as shown in FIG. 10B, the fastener element member 10*b* is sewn by a sewing yarn 16 on a fastener tape 17. FIG. 11A shows a zigzag fastener element member formed by bending a continuous rectilinear strip of a synthetic material in a zigzag shape. FIG. 11B shows the fastener element member which is sewn by a sewing yarn 16 on a fastener tape 17 after it has been subjected to the metallic coating treatment. FIGS. 12A to 15C show several embodiments wherein separate or individual fastener elements are attached to connecting cords. FIGS. 12A and 15A show individual fastener element members 10*d* and 10*h*, respectively, molded by synthetic resin extrusion molding machines in the form of stairs along two lengths of longitudinally spaced apart connection cords 18 and 21, respectively, and which are bent in a U-shape about their interdigitating portions 22 and 23, respectively, after they have been subjected to the metallic coating treatment. Thereafter, they are sewn by a sewing yarn 16 onto the fastener tape 17, as shown in FIGS. 12B and 15C, respectively. FIG. 12B shows an embodiment wherein the surface of each of the fastener element members 10*d* to be exposed when it is attached to the fastener tape 17 is subjected to the metallic coating treatment. FIG. 15C shows an embodiment wherein each of the fastener element members 10*h* is formed of a transparent or transluscent synthetic resin, and as shown in FIGS. 15B and 15C, respectively, the surface of each of the fastener element members 10*h*, which is kept in contact with the fastener tape 17, is applied with an under coat layer having any color and which can be seen through it. Then the under coat layer thus formed is applied with a metallic coating layer and a finishing coat layer in turn so that when the fastener element member 10*h* is attached to the fastener tape 17, a metallic coating layer 24 having a metallic luster can be seen through the fastener element member 10*h*. By so doing, an advantage wherein the metallic coating is not damaged by the sliding contact of a slider 25 therewith can be obtained. FIG. 13A shows individual fastener element members 10*e* formed along a connection cord 19 at regular intervals by a synthetic material injection molding machine. FIG. 13B shows the fastener element members 10*e* woven into a fastener tape 17 after they have been applied with a metallic coating layer. FIG. 14A shows individual metallic fastener element members 10*f* attached to a connection cord 20 at regular intervals along the latter. FIG. 14B shows the fastener element members 10f woven into a fastener tape 17 after they have been applied with a metallic coating layer. Further, as can be seen from the foregoing description, the present invention can be applied to various kinds of fastener element members. In the case of the fastener element members attached to one side of the fastener tape as shown in FIGS. 9B and 10B, only one of the surfaces of the fastener element member which is exposed to the outside is applied with a metallic coating layer. Whilst, in the case of the fastener elements each of which is woven into the fastener tape simultaneously with the weaving of the latter as shown in FIGS. 9C, 12B, 13B and 14B, respectively, and also in the case of the fastener elements each of which is attached to the fastener tape by sandwiching the latter therein, both the front and rear surfaces of the fastener element member located on the front and rear surfaces of the fastener tape are applied with a metallic coating layer. Further, the fastener element members shown in FIGS. 9C, 11B, 12B and 13B, respectively, are made of a synthetic resin, and can be put in any desired color by mixing a pigment in the resin or by dyeing. Therefore, after the fastener element members have been colored by mixing the synthetic resin with a colored pigment, which enables a color inclining toward a color tone of the metallic coating layer to be applied to the surface thereof to be achieved, or alternatively by dyeing, only the surface of the fastener element member may be applied with a metallic coating layer. Further, as shown in FIG. 15C, it is possible to apply only the surface of the fastener element member which is kept in contact with the fastener tape with a metallic coating layer so that the latter having a metallic luster can be seen through the fastener element member. FIGS. 16A and 16B show a slide fastener comprising fastener elements applied with a metallic coating layer having a metallic luster according to the present invention. If, in addition to the fastener elements, the surfaces of a slider 25, upper stops 26, a bottom stop 27, a separable terminal assembly 28, etc. are each applied with a metallic coating layer and a finishing coat layer in turn in the same manner as in the case of the fastener elements so as to apply them with a metallic coating layer having a unified metallic luster throughout the slide fastener excepting the fastener tapes 17, then a much more enhanced aesthetic sense or effect can be obtained.

What is claimed is:

1. A slide fastener, comprising: fastener elements formed of at least one fastener element member made of a synthetic resin and having a metallic coating layer with a thickness of 0.001 to less than 1.0 μm formed on a surface thereof so as to give the surface of the fastener element member a metallic luster.

2. A slide fastener as claimed in claim 1, characterized in that said fastener element member made of a synthetic resin is a member selected from the group consisting of a continuous coiled or zigzag fastener element member, and the continuous fastener element member is sewn by a sewing yarn onto one side of a fastener tape.

3. A slide fastener as claimed in claim 2, characterized in that said sewing yarn comprises a transparent yarn.

4. A slide fastener as claimed in claim 2, characterized in that said continuous fastener element member has cord inserted therethrough, and the cord also has a metallic coating layer with a thickness of at least 0.01 μm or over formed thereon.

5. A slide fastener as claimed in claim 2, characterized in that said continuous fastener element member has a cord inserted therethrough, and the cord also has a metallic coating layer with a thickness of 0.01 μm or over formed thereon, and said sewing yarn comprises a transparent yarn.

6. Slide fastener elements, comprising: a fastener element member of a synthetic resin having a metallic coating layer means formed on a surface thereof for providing a metallic luster, and said metallic coating layer means formed on the fastener element member having a translucent finishing coat layer formed thereon.

7. Slide fastener elements as claimed in claim 6 wherein a thickness of said metallic coating layer is in a range of 0.05 to less than 1.0 μm.

8. Slide fastener elements, comprising: a fastener element member of a synthetic resin having a surface with an under coat layer formed thereon, a surface of the under coat layer having a metallic coating layer formed thereon, and a surface of the metallic coating layer having a translucent finishing coat layer formed thereon.

9. Slide fastener elements as claimed in claim 7 wherein a thickness of said metallic coating layer is in a range of 0.05 to less than 1.0 μm.

10. Slide fastener elements, comprising:

at least one fastener element member made of a synthetic resin;

a metallic coating layer with a thickness of 0.001 to less than 1.0 μm formed on a surface of the fastener element member so as to give the surface of the fastener element member a metallic luster; and a finishing coat layer on the metallic coating layer formed of a material selected from the group consisting of a thermosetting, electro radiation curing, and ultraviolet curing synthetic resins.

11. Slide fastener elements according to claim 10 wherein the thickness of the metallic coating layer is in a range of 0.05 to 0.3 μm.

12. Slide fastener elements according to claim 11 wherein an undercoat layer is provided between the metallic coating layer and the surface of the fastener element member.

13. Slide fastener elements according to claim 10 wherein a cord runs through the fastener element member and the cord is coated with a metallic coating layer.

14. Slide fastener elements, comprising:

at least one fastener element member made of a synthetic resin;

an undercoat layer formed on a surface of the fastener element member;

a metallic coating layer with a thickness of 0.001 to less than 1.0 μm formed on a surface of the fastener element member; and a finishing coat layer protecting the metallic coating layer and formed of a material selected from a group consisting of thermosetting, electron radiation curing, and ultraviolet curing synthetic resins.

15. Slide fastener elements according to claim 14 wherein the finishing coat layer is translucent.

16. Slide fastener elements according to claim 14 wherein the finishing coat layer is transparent.

* * * * *